US008723010B1

(12) United States Patent
Knights

(10) Patent No.: US 8,723,010 B1
(45) Date of Patent: May 13, 2014

(54) PORTABLE MUSICAL KEYBOARD STAND WITH AUXILIARY SUPPORT ARMS

(71) Applicant: Reginald M. Knights, Seffner, FL (US)

(72) Inventor: Reginald M. Knights, Seffner, FL (US)

( * ) Notice: Subject to any disclaimer, the term of this patent is extended or adjusted under 35 U.S.C. 154(b) by 0 days.

(21) Appl. No.: 13/845,782

(22) Filed: Mar. 18, 2013

(51) Int. Cl.
*G10C 3/12* (2006.01)

(52) U.S. Cl.
USPC ..... 84/424

(58) Field of Classification Search
USPC ..... 84/424, 327, 329, 421; 248/121, 122.1, 248/124.1, 124.2, 125.1, 125.2, 164, 125.3, 248/125.7, 125.9, 127, 166, 460, 463, 464
See application file for complete search history.

(56) References Cited

U.S. PATENT DOCUMENTS 4,617,851 A 10/1986 Sato
4,684,091 A 8/1987 Moreschi
4,754,711 A 7/1988 Solomon
4,770,380 A * 9/1988 Eason et al. ..... 248/165
5,312,076 A * 5/1994 Rogov ..... 248/165
2006/0185495 A1 * 8/2006 Hsieh ..... 84/327

* cited by examiner

*Primary Examiner* — Kimberly Lockett
(74) *Attorney, Agent, or Firm* — Crossley Patent Law; Micah C. Gunn

(57) ABSTRACT

A portable musical keyboard stand having auxiliary support arms, including identical parallel right and left side frames, each including an upright member, a rear leg disposed at an angle relative thereto, and a brace attached between a bottom end thereof and a lower end of the rear leg. Horizontal crossbars, including a lowermost crossbar, are continuously attached between the frames. Cross-beam members have a top side attached to the lowermost crossbar proximal a center point thereof and a bottom side attached to the respective rear leg. At least one support arm member is attached to the outer side of one of the frames parallel to a respective brace. A pair of L-shaped mounting brackets is attached to each of the horizontal crossbars and the support arm member at an angle thereto to retain a portable musical keyboard and a sound mixer thereon, respectively.

7 Claims, 5 Drawing Sheets

PORTABLE MUSICAL KEYBOARD STAND WITH AUXILIARY SUPPORT ARMS

BACKGROUND OF THE INVENTION

Various types of frames to support musical instruments are known in the prior art. However, what is needed is a portable musical keyboard stand with auxiliary support arms.

FIELD OF THE INVENTION

The present invention relates to musical instrument support frames and more particularly, to a portable musical keyboard stand with auxiliary support arms.

SUMMARY OF THE INVENTION

The general purpose of the present portable musical keyboard stand with auxiliary support arms, described subsequently in greater detail, is to provide a portable musical keyboard stand with auxiliary support arms which has many novel features that result in a portable musical keyboard stand with auxiliary support arms which is not anticipated, rendered obvious, suggested, or even implied by prior art, either alone or in combination thereof.

To accomplish this, the present musical keyboard stand with auxiliary support arms is structured to allow a musician to retain multiple portable musical keyboards and sound mixers on a single portable rack. The instant portable musical keyboard stand with auxiliary support arms includes a right side frame and a left side frame disposed parallel thereto, each of which includes an upright member having a top end, a bottom end, and an outer side. A rear leg, having an upper end centrally attached to the upright member and a lower end, is disposed at an angle relative the upright member. A brace is attached between the bottom end of the upright member and the lower end of the rear leg. Spaced apart horizontal crossbars, one of which is a lowermost crossbar, are continuously disposed between the right and left side frames. The lowermost crossbar has an outer end disposed proximal the upper end of the rear leg. Each of a pair of cross-beam members has a top side attached to the lowermost crossbar proximal a center point thereof and a bottom side attached to the respective rear leg. At least one support arm member is attached to the outer side of one of the right side frame and the left side frame in a position parallel to a respective brace. Each support arm member, which can be parallelepiped, has a length shorter than a length of one of the horizontal crossbars. L-shaped mounting brackets are attached to each of the horizontal crossbars and the support arm member at an angle respective to the horizontal crossbar and the support arm member. A mounting bracket is disposed at a 45-degree angle respective a horizontal midline axis of each of the horizontal crossbars and each support arm member. The mounting brackets are disposed in pairs in a position parallel to each other on each of the horizontal crossbars and the support arm member. Each of the support arms and mounting brackets and their respective pair of mounting brackets are configured to retain a portable sound mixer and portable musical keyboard, respectively, thereon.

The present device assists in organizing musical keyboards and is more convenient to carry than multiple racks for the musical keyboards. However, the device can also be used to mount displays, accessories, and printed material. The present device is durable and portable. Thus has been broadly outlined the more important features of the present portable musical keyboard stand with auxiliary support arms so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
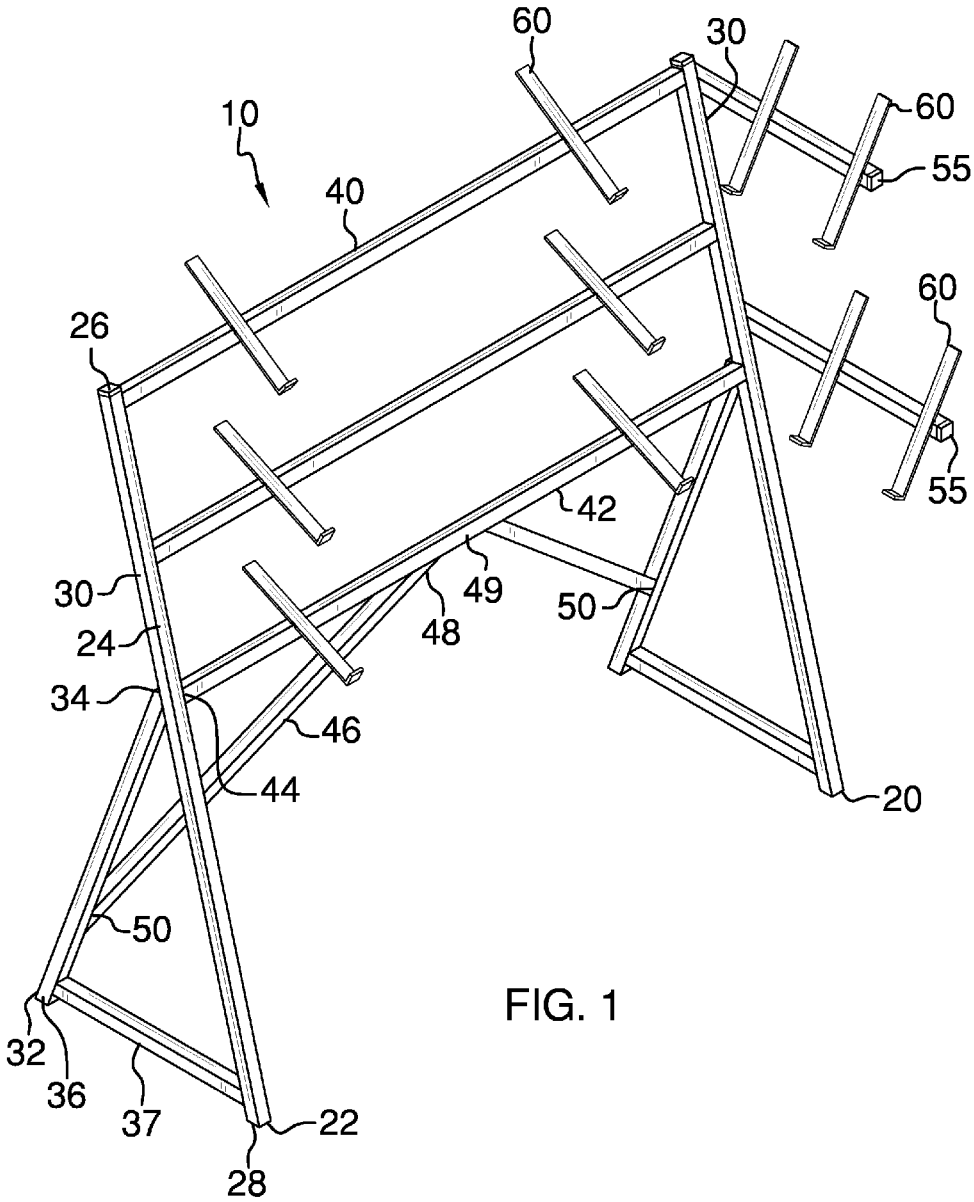
FIG. 1 is an isometric view.
Figure 2:
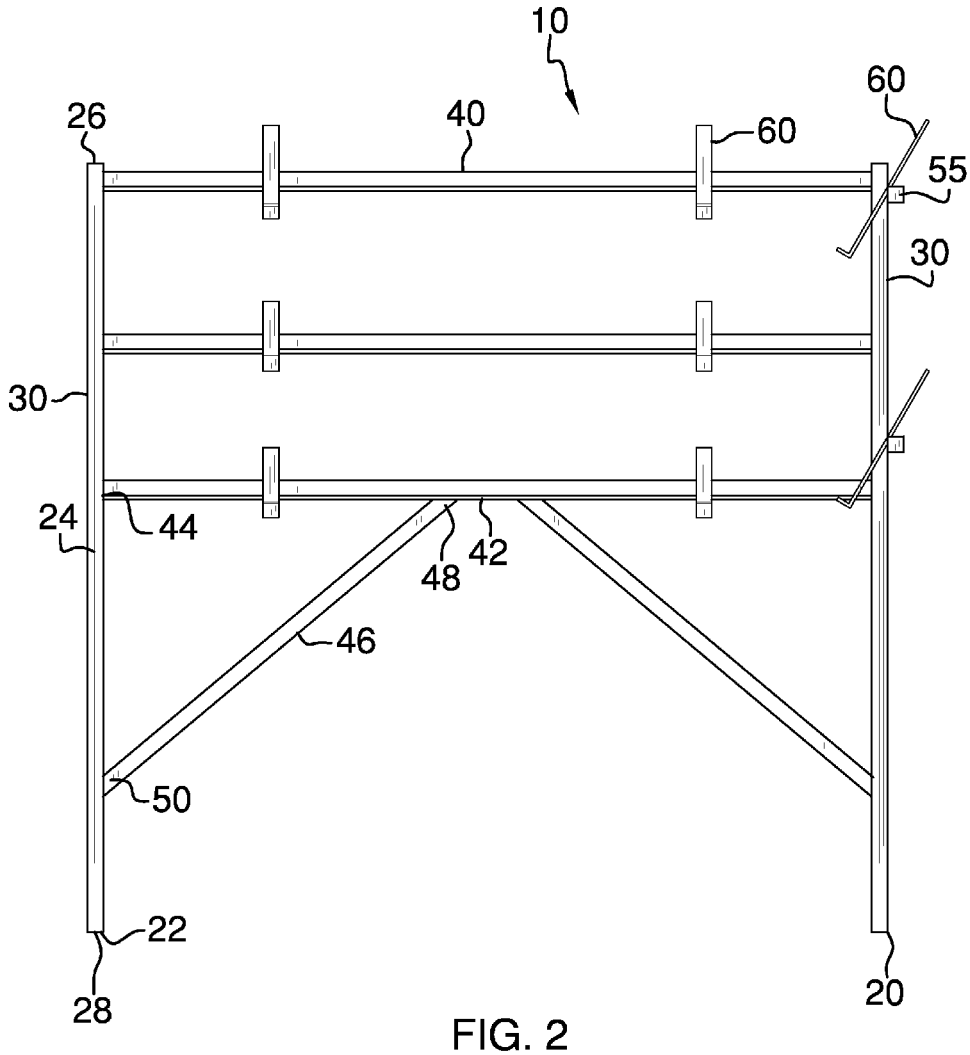
FIG. 2 is a front elevation view.
Figure 3:
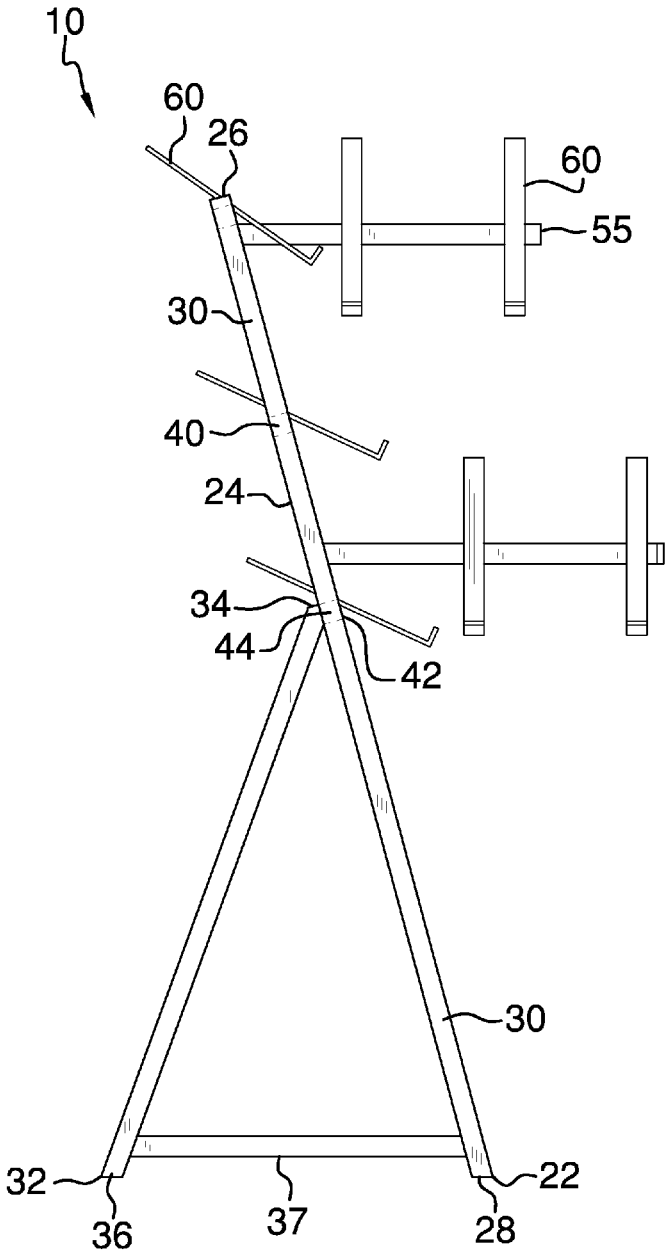
FIG. 3 is a left side elevation view.
Figure 4:
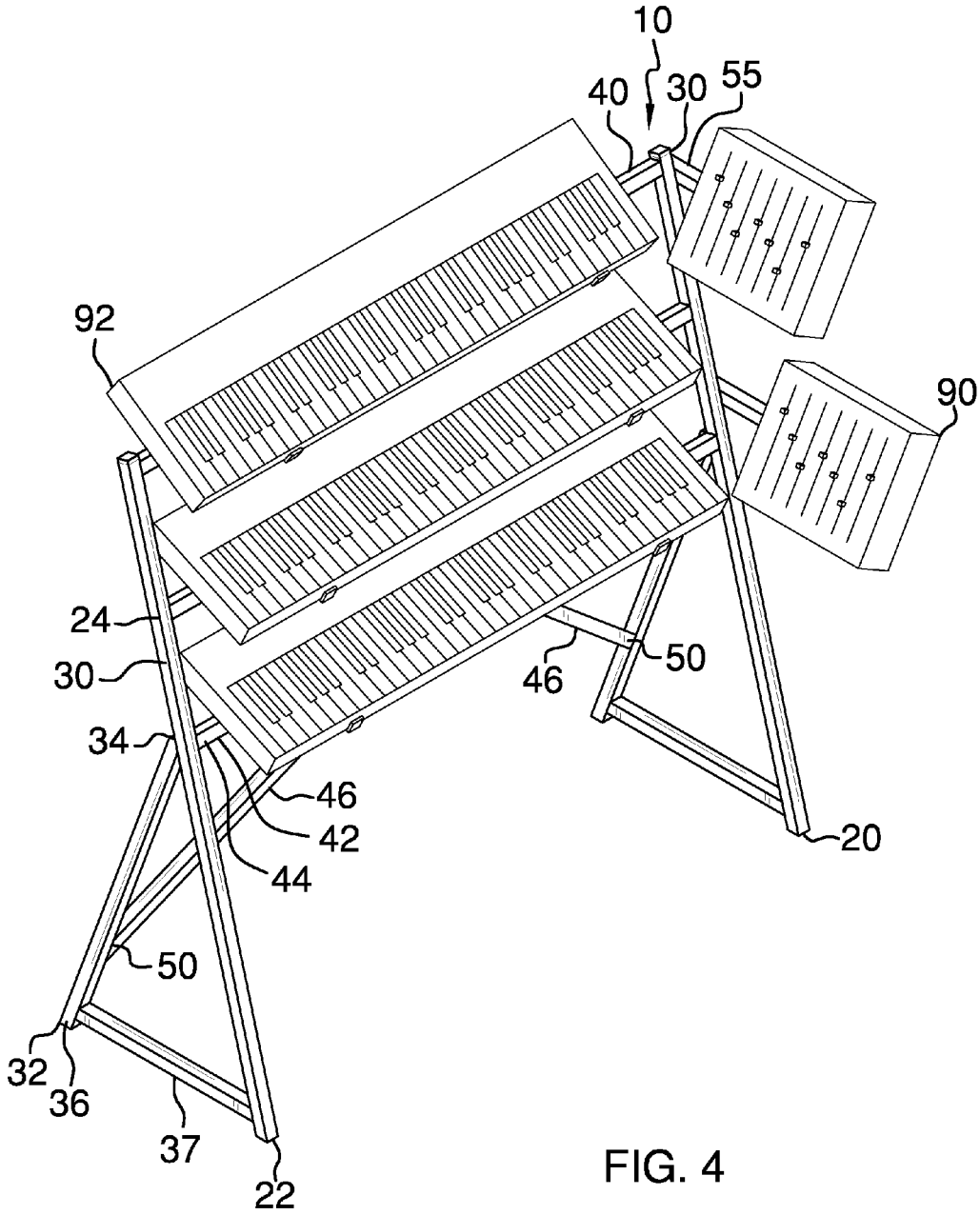
FIG. 4 is an in-use view.
Figure 5:
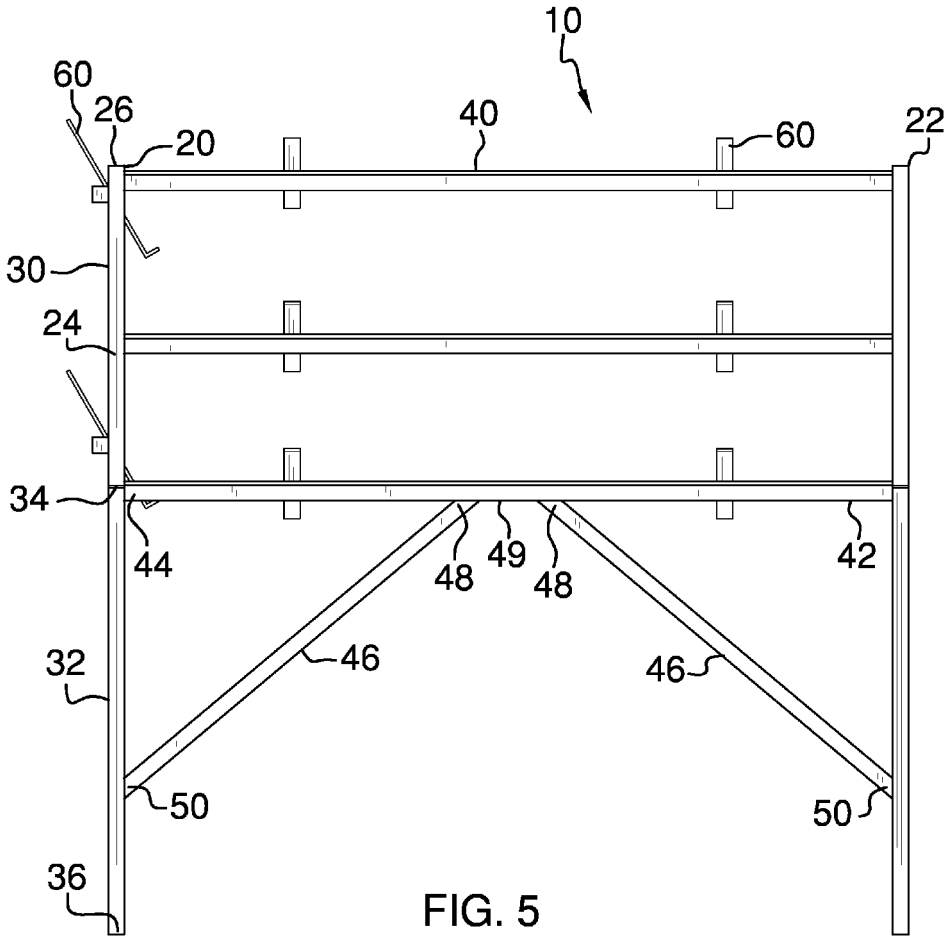
FIG. 5 is a rear elevation view.

With reference now to the drawings, and in particular FIGS. 1 through 5 thereof, an example of the instant portable musical keyboard stand with auxiliary support arms employing the principles and concepts of the present portable musical keyboard stand with auxiliary support arms and generally designated by the reference number 10 will be described.

Referring to FIGS. 1 through 5, the present portable musical keyboard stand with auxiliary support arms 10 is illustrated. The portable musical keyboard stand with auxiliary support arms 10 includes a right side frame 20 and a left side frame 22 disposed parallel to the right side frame 20. Each of the right side frame 20 and the left side frame 22 includes an upright member 24 having a top end 26, a bottom end 28, and an outer side 30. A rear leg 32 is disposed at an angle relative the upright member 24. The rear leg 32 has an upper end 34 centrally attached to the upright member 24 and a lower end 36. A brace 37 is attached between the bottom end 28 of the upright member 24 and the lower end 36 of the rear leg 32.

A plurality of spaced apart horizontal crossbars 40 is continuously attached between the right side frame 20 and the left side frame 22. The horizontal crossbars 40 include a lowermost crossbar 42. The lowermost crossbar 42 has an outer end 44 disposed proximal the upper end 34 of the rear leg 32. A pair of cross-beam members 46 is also provided. Each cross-beam member 46 has a top side 48 attached to the lowermost crossbar 42 proximal a center point 49 thereof and a bottom side 50 attached to the respective rear leg 32.

At least one support arm member 55 is attached to the outer side 30 of one of the right side frame 20 and the left side frame 22 in a position parallel to a respective brace 37. Each support arm member 55 has a length shorter than a length of one of the horizontal crossbars 40. The support arm member 55 can be parallelepiped as illustrated.

A plurality of L-shaped mounting brackets 60 is attached to each of the horizontal crossbars 40 and the support arm member 55 at an angle respective to the horizontal crossbar 40 and the support arm member 55. Each of the horizontal crossbars 40 and each support arm member 55 have a horizontal midline axis. Each mounting bracket 60 is disposed at a 45-degree angle respective the horizontal midline axis of each of the horizontal crossbars 40 and each support arm member 55. The mounting brackets 60 are disposed in pairs in a position parallel to each other on each of the horizontal crossbars 40 and the support arm member 55. Each support arm 55 and each pair of mounting brackets 60 disposed thereon are configured to retain a portable sound mixer 90 thereon. Each pair of mounting brackets 60 disposed on each of the horizontal crossbars 40 is configured to retain a portable musical keyboard 92 thereon.

What is claimed is:

1. A portable musical keyboard stand with auxiliary support arms comprising:

a right side frame;

a left side frame disposed parallel to the right side frame;

each of the right side frame and the left side frame comprising:

an upright member having a top end, a bottom end, and an outer side;

a rear leg disposed at an angle relative the upright member, the rear leg having an upper end and a lower end, the upper end centrally disposed on the upright member;

a brace disposed between the bottom end of the upright member and the lower end of the rear leg;

a plurality of spaced apart horizontal crossbars continuously attached between the right side frame and the left side frame;

a lowermost crossbar of the horizontal crossbars, the lowermost crossbar having an outer end disposed proximal the upper end of the rear leg;

a pair of cross-beam members, each cross-beam member having a top side attached to the lowermost crossbar proximal a center point thereof and a bottom side attached to the respective rear leg;

at least one support arm member attached to the outer side of one of the right side frame and the left side frame in a position parallel to a respective brace; and a plurality of L-shaped mounting brackets attached to each of the horizontal crossbars and the support arm member.

2. The portable musical keyboard stand with auxiliary support arms of claim 1 wherein the mounting brackets are disposed in pairs in a position parallel to each other on each of the horizontal crossbars and the support arm member.

3. A portable musical keyboard stand with auxiliary support arms comprising:

a right side frame;

a left side frame disposed parallel to the right side frame;

each of the right side frame and the left side frame comprising:

an upright member having a top end, a bottom end, and an outer side;

a rear leg disposed at an angle relative the upright member, the rear leg having an upper end centrally disposed on the upright member and a lower end;

a brace disposed between the bottom end of the upright member and the lower end of the rear leg;

a plurality of spaced apart horizontal crossbars continuously disposed between the right side frame and the left side frame;

a lowermost crossbar of the horizontal crossbars, the lowermost crossbar having an outer end disposed proximal the upper end of the rear leg;

a pair of cross-beam members, each cross-beam member having a top side attached to the lowermost crossbar proximal a center point thereof and a bottom side attached to the respective rear leg;

at least one support arm member attached to the outer side of one of the right side frame and the left side frame in a position parallel to a respective brace, each support arm member having a length shorter than a length of one of the horizontal crossbars; and a plurality of L-shaped mounting brackets attached to each of the horizontal crossbars and the support arm member at an angle respective to the horizontal crossbar and the support arm member.

4. The portable musical keyboard stand with auxiliary support arms of claim 3 further comprising:

a horizontal midline axis of each of the horizontal crossbars and each support arm member;

wherein each mounting bracket is disposed at a 45-degree angle respective the horizontal midline axis of each of the horizontal crossbars and each support arm member.

5. The portable musical keyboard stand with auxiliary support arms of claim 4 wherein the mounting brackets are disposed in pairs in a position parallel to each other on each of the horizontal crossbars and the support arm member.

6. A portable musical keyboard stand with auxiliary support arms comprising:

a right side frame;

a left side frame disposed parallel to the right side frame;

each of the right side frame and the left side frame comprising:

an upright member having a top end, a bottom end, and an outer side;

a rear leg disposed at an angle relative the upright member, the rear leg having an upper end centrally disposed on the upright member and a lower end;

a brace disposed between the bottom end of the upright member and the lower end of the rear leg;

a plurality of spaced apart horizontal crossbars continuously attached between the right side frame and the left side frame;

a lowermost crossbar of the horizontal crossbars, the lowermost crossbar having an outer end disposed proximal the upper end of the rear leg;

a pair of cross-beam members, each cross-beam member having a top side attached to the lowermost crossbar proximal a center point thereof and a bottom side attached to the respective rear leg;

at least one support arm member attached to the outer side of one of the right side frame and the left side frame in a position parallel to a respective brace, each support arm member having a length shorter than a length of one of the horizontal crossbars;

a plurality of L-shaped mounting brackets attached to each of the horizontal crossbars and the support arm member at an angle respective to the horizontal crossbar and the support arm member;

a horizontal midline axis of each of the horizontal crossbars and each support arm member;

wherein each mounting bracket is disposed at a 45-degree angle respective the horizontal midline axis of each of the horizontal crossbars and each support arm member; and wherein the mounting brackets are disposed in pairs in a position parallel to each other on each of the horizontal crossbars and the support arm member.

7. The portable musical keyboard stand with auxiliary support arms of claim 6 wherein each support arm and each pair of mounting brackets disposed on each support arm are configured to retain a portable sound mixer thereon.

* * * * *